United States Patent [19]

Heimberger

[11] 4,172,308

[45] Oct. 30, 1979

[54] FASTENER

[75] Inventor: Helmut Heimberger, Locarno, Switzerland

[73] Assignee: Optilon W. Erich Heilmann GmbH, Cham, Switzerland

[21] Appl. No.: 876,732

[22] Filed: Feb. 10, 1978

Related U.S. Application Data

[62] Division of Ser. No. 785,167, Apr. 6, 1977, Pat. No. 4,117,575.

[30] Foreign Application Priority Data

Apr. 7, 1976 [DE] Fed. Rep. of Germany ..... 2615051

[51] Int. Cl.[2] ..... A44B 19/14

[52] U.S. Cl. ..... 24/205.13 D

[58] Field of Search ..... 24/205.13 D

[56] References Cited

U.S. PATENT DOCUMENTS

| | | | |
|---|---|---|---|
| 2,252,305 | 8/1941 | Puschner | 24/205.13 D |
| 3,755,879 | 9/1973 | Cuckson | 24/205.13 D |
| 4,033,014 | 7/1977 | Manning | 24/205.13 D |
| 4,037,295 | 7/1977 | Rojahn | 24/205.13 D |

FOREIGN PATENT DOCUMENTS

| | | | |
|---|---|---|---|
| 226386 | 11/1959 | Australia | 24/205.13 D |

*Primary Examiner*—Bernard A. Gelak
*Attorney, Agent, or Firm*—Karl F. Ross

[57] ABSTRACT

A fastener of the type in which two arrays of spaced-apart coupling heads are juxtaposed and pressed together, either with or without a slider, so that the heads of one array or row are received in the inter-head spaces of the other row and vice versa, is provided with a pair of spaced apart connecting strands extending the full length of the respective row and integral (unitary) with the coupling heads or their connecting shanks. The strands, molded monolithically with the remainder of the unit, flexibly interconnect the coupling heads and serve as stops for relative lateral movement of the rows upon their interconnection.

4 Claims, 6 Drawing Figures

FASTENER

CROSS REFERENCE TO RELATED APPLICATIONS

This application is a division of Ser. No. 785,167 filed Apr. 6, 1977 (now U.S. Pat. No. 4,117,575 issued Oct. 3, 1978).

FIELD OF THE INVENTION

The present invention relates to a fastener and, more particularly, to fasteners of the type which comprise two rows of coupling heads which can be pressed together so that the heads of one row are received in the interstices or inter-head spaces of the opposite row and vice versa, either with the aid of a slider or by hand.

BACKGROUND OF THE INVENTION

It is a common practice in the slide-fastener art to provide two rows of coupling heads or members such that the heads of one row can be fitted between the heads of the other row; i.e. into the interstices or inter-head spaces upon movement of a slider along the two rows.

In a slider fastener, each of the rows of coupling heads can be mounted upon a respective fabric edge, i.e. on one edge of a support tape, by molding, stitching or passing the coupling head through an opening provided in the fabric web of the tape.

In general, a slider can be provided to press the two rows of coupling heads together transversely to the slide fastener or coupling plane or in this plane, i.e. to laterally interfit the heads of the two rows.

There are also known slider-free coupling devices in which two rows of coupling heads are provided on opposite edges to be secured together, one row being pressed against the other by hand so as to force the heads of the first row into the interstices or inter-head spaces of the second row and vice versa.

Slide fasteners and slider-free fasteners of the aforedescribed type are available in a variety of configurations and can have discrete coupling heads individually fastened to the support or can have the coupling heads formed as part of a continuous coupling element, e.g. of a synthetic-resin or thermoplastic material. The present invention is concerned with a fastener of the type in which two identical coupling elements, having coupling-head carriers extending orthogonal to the longitudinal axis of the fastener, are composed of synthetic-resin and having on each of the carriers, a coupling head preferably formed from synthetic-resin material. In such cases, the coupling head carrier can comprise a connecting shank whereby the coupling element can be held onto a fabric, support tape or the like, with spaces being provided between these shanks and the respective heads to receive the coupling heads of the other coupling element. In general the coupling heads of the other coupling element are forced between the heads of the first under pressure. As has already been noted, the pressing of the heads of one row or element between the heads of the other row or element can be effected with or without a slider.

In German published application (Auslegeschrift) DT-AS No. 1 937 746, the connecting strands between the coupling heads are textile support strands upon which the coupling head carriers are seated, each carrier comprising a pair of coupling heads which flank the centrally extending support strand of textile. The coupling head carriers are provided with individual abutments restricting relative transverse movement of the coupling head of the other row upon interengagement (interdigitation) of the two rows of coupling members.

This arrangement has not been found to be free from disadvantages. For example, in the fabrication of the fastener and fastener stringers or fastener halves utilizing the coupling members the textile support strand must be passed through the apparatus in which the coupling-head carriers and the coupling heads are formed. These devices are generally injection-molding forms or dies which must be especially adapted to receive the foreign textile support strand.

Another disadvantage of the conventional system is that the connection formed between the textile strand and the coupling member during the injection molding process is often not sufficient to enable the assembly to take up all of the stresses which are applied during operation of the fastener.

OBJECTS OF THE INVENTION

It is the principal object of the present invention to provide a fastener with which the aforedescribed disadvantages are obviated.

Another object of this invention is to provide a fastener which eliminates the need to pass a textile strand through an injection mold during the fabrication of the fastener or its parts.

Yet another object of the invention is the provision of a fastener of improved design and lower cost than conventional fasteners for corresponding purposes.

SUMMARY OF THE INVENTION

These objects and others which will become apparent hereinafter are attained, in accordance with the present invention whereby the system described in the aforementioned publication is improved by connecting the coupling members, each having the respective coupling heads in spaced-apart relationship, with a pair of transversely spaced longitudinally extending connecting strands unitarily, integrally and monolithically formed on the coupling members out of the same material as these members and in one piece therewith without the heterogeneous junction so that the strands flexibly interconnect the members and at the same time form respective lateral abutments preventing transverse displacement of the coupling elements whose heads are received between the coupling members of the coupling element provided with these strands.

When reference is made to relative transverse displacement or lateral shifting, it is to be understood that, in the absence of the two strands, the head of one coupling element might shift laterally relative to the heads of the coupling elements when the two are interfitted perpendicular to the longitudinal axis or dimension of the fastener. Thus, if the two strands lie in a common plane, as is the case in accordance with a feature of the invention, this plane can be considered to the slide-fastener plane, the pressure with which the coupling elements are connected being applied generally transversely to this plane. In this case, the strands prevent relative shifting of the two coupling elements parallel to the plane and pass perpendicular to the direction in which the pressure was applied to couple the elements together. Thus, the strands form flexible connectors between the coupling head carriers with which they are unitarily formed and serve simultaneously as transverse-shifting abutments to resist relative displacement of the connecting coupling elements in the slide fastener plane.

The most immediate recognizable advantage of the system of the present invention is that it completely eliminates the need for textile support strands which would otherwise have to be fed through an injection mold or the like in which the coupling-heads are formed to mold these carriers around the material of the textile strand. The synthetic-resin connecting strands which are formed unitarily with the coupling-head carriers according to the present invention, can be relatively thin and of small cross section so that they impart the desired flexibility of the fastener in spite of the fact that they are unitary and monolithic, i.e. in one piece with the coupling head carriers. Furthermore, since the connecting strands merge homogeneously with the carriers, concern for a weak junction or attachment is eliminated.

Furthermore, since two connecting strands are provided, the entire coupling element can be made with small tolerances and a particularly fine gauge or inter-head spacing.

It is of special advantage that the connecting bars between successive coupling head carriers, which bars collectively form the strands, function as lateral-shift-preventing abutments which prevent the head of the other element which is received between two coupling members, from slipping laterally out of engagement with the heads of the members defining the space of the first coupling element.

It is frequently possible to eliminate special transverse abutments on the individual members in this manner although such abutments may additionally be provided as described below. According to a preferred embodiment of the invention the coupling heads are mushroom or semimushroom shaped heads which have shoulders at the edges of the mushroom heads engaging beneath the mushroom heads of the other row of coupling heads.

According to another feature of the invention, each coupling element can be provided with two rows of coupling heads, i.e. two transversely spaced coupling heads an each coupling-head carrier, or with a single row of coupling heads, i.e. a single coupling head on each carrier. In the first embodiment wherein each coupling element has two rows of coupling heads, the connecting strands are provided to opposite sides of a longitudinal median plane through the coupling element and each coupling-head carrier but inwardly of the two rows of coupling heads. The longitudinal median plane is the plane which extends perpendicularly to the fastener plane as defined above along the longitudinal dimension of the fastener.

Where each coupling element has only a single row of coupling heads, the coupling heads may be disposed along the longitudinal median plane while the connecting strands are disposed to either side of this plane and flank the row of coupling heads. In this embodiment it has been found to be advantageous to provide additional abutments to restrict lateral displacement as will be apparent hereinafter.

It will be apparent from the foregoing that the fastener of the present invention is completely free from the disadvantages of systems using textile strands and hence that the textile can be fabricated more simply and economically. It can be produced by extrusion of a synthetic-resin profile strip, the extruded strip being shaped to the desired configuration on forming wheels or drums by plastic deformation.

BRIEF DESCRIPTION OF THE DRAWING

The above and other objects, features and advantages of the present invention will become more readily apparent from the following description, reference being made to the accompanying drawing in which.

SPECIFIC DESCRIPTION

The fastener elements described below are intended to be used in the same manner as the elements described in the aforementioned German published application DT-AS No. 1 937 746.

Figure 1:
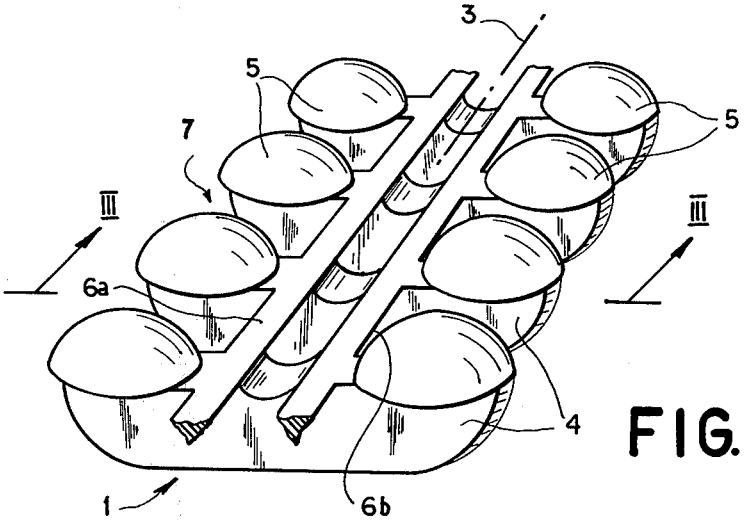
FIG. 1 is a plan view of one coupling element of a fastener according to the present invention, as seen from the side thereof which is intended to engage the other coupling element (not shown)
Figure 2:
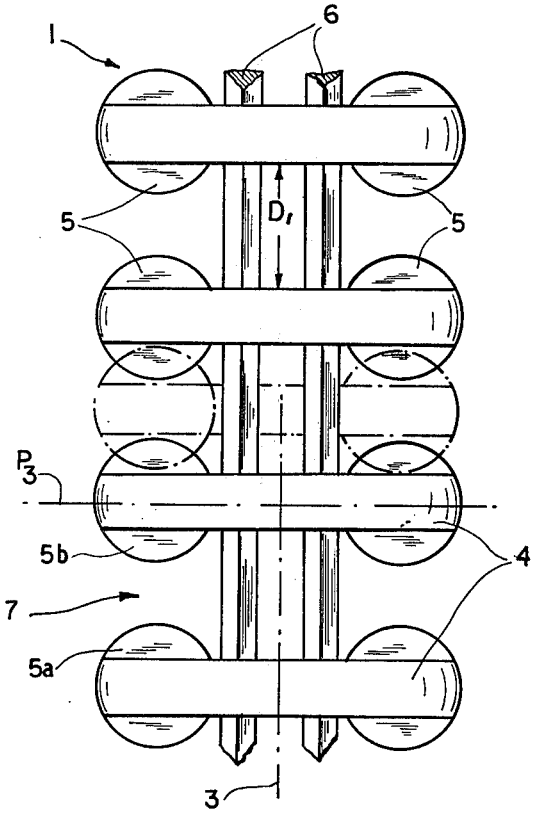
FIG. 2 is a plan view of the coupling element in FIG. 1 as seen from the opposite side.
Figure 3:
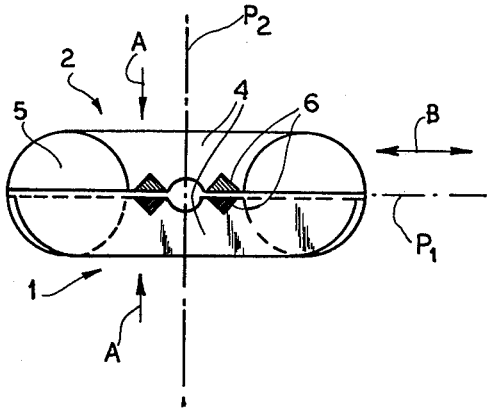
FIG. 3 is a cross-sectional view taken along the line III—III of FIG. 1 but illustrating the mutually coupled state of two coupling elements according to the invention.

The coupling elements 1 and 2 illustrated in FIGS. 1 through 3 are intended to form part each of a respective fastener stringer and hence can be considered as a pair of fastener coupling halves. Each of the coupling halves comprises a plurality of coupling-head carriers or shanks 4 which lie perpendicularly to the longitudinal axis 3 of the fastener in respective planes $P_3$ which are perpendicular to axis 3. The carriers 4 are spaced apart by a distance $D_1$ along the axis 3 and each carries at its ends a respective coupling head 5 of mushroom shape.

The coupling heads 5 and the carriers 4 are unitarily formed from (i.e. constitute one piece) with a thermoplastic synthetic-resin. The heads 5 overhang *5a* and *5b* to define inter-head spacing 7 between them in which the coupling head of an opposed coupling element can be received. The two coupling elements can be pressed together in the direction of arrows A and defining fastener plane $P_1$ which is perpendicular to the plane of the paper in FIG. 3. The coupling elements also have a longitudinal median plane $P_2$ perpendicular to the plane $P_3$ and also perpendicular to the plane of the paper in FIG. 3.

Flanking the longitudinal median plane, but inwardly of the two rows of coupling heads 5, there are provided two mutually parallel connecting strands 6 of triangular profile, the portions *6a* and *6b* of the strands between each carrier 4 forming flexible ligatures which also function as stops to prevent transverse shifting (arrow B) of the coupling elements 2 relative to the coupling element 1. Thus the strands 6, which are unitary (formed in one piece) with the carriers 4 and the heads 5 which not only connect the carriers together, but also form abutments preventing lateral shifting of the two coupling elements when the two are joined together.

Figure 4:
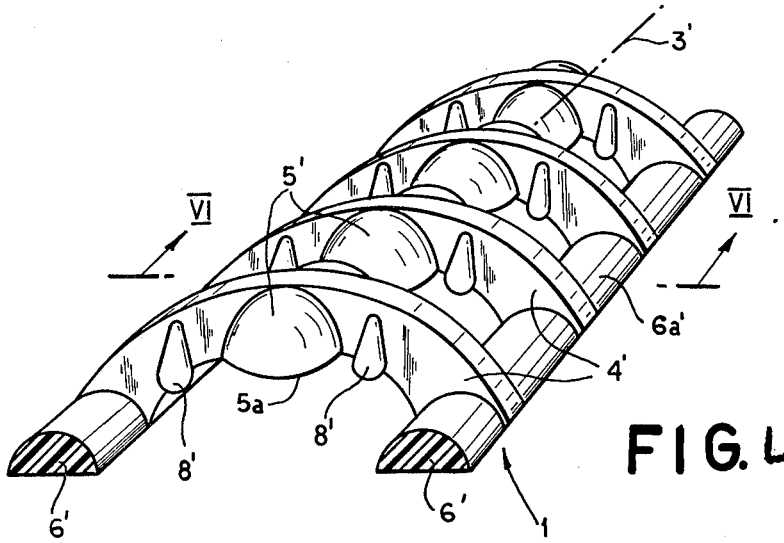
FIG. 4 is generally similar to FIG. 1 illustrating another embodiment of the invention.
Figure 5:
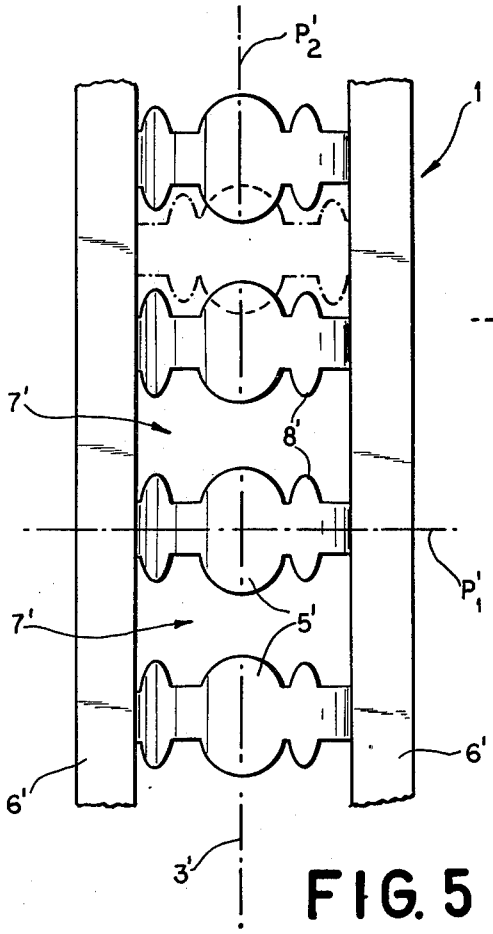
FIG. 5 is a view of the embodiment of FIG. 4 as seen from the opposite side.
Figure 6:
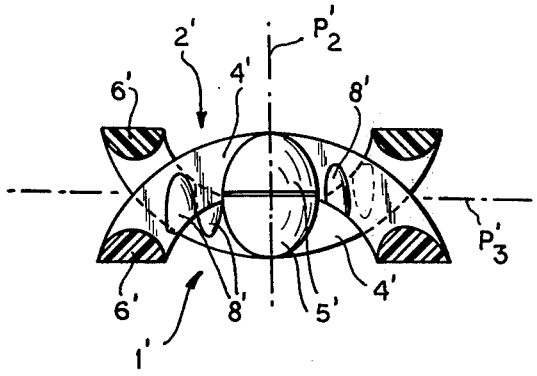
FIG. 6 is a cross-sectional view taken along the line VI—VI of FIG. 4 with two coupling elements in their connected state.

In FIGS. 4 through 6, similarly functioning parts have been designated with the same reference numerals as those used in FIGS. 1 through 3 although primed. In this case, the coupling head carriers 4' are bowed and are formed centrally with mushroom coupling heads 5' whose edges 5a' overhand the spaces 7' between the carriers 4'.

The connecting strands 6' which are formed unitarily with the heads and the carriers here engage the outer ends of the carriers to provide flexible ligatures 6a' between them. These ligatures 6a', as in the embodiment of FIGS. 1 through 3, limit the lateral shifting of the heads 5' of the two coupling elements 1' and 2' when the latter are connected together as shown in FIG. 6.

In addition, the carriers 4' may be provided, flanking each head 5', respective pairs of projections 8' which interfit with the projections of the opposing coupling element to further resist lateral displacement. In this embodiment, the slide fastener plane has been represented at $P'_3$, the longitudinal median plane at $P'_2$ and the planes of the carriers 4' at $P'_1$.

It will be apparent that the coupling elements both of FIGS. 1 through 3 and of FIGS. 4 through 6 can be extruded as a plastically deformable profile and then shaped in appropriately configured beads of a forming wheel. The coupling elements can be attached by stitching or thermal bonding (fusion welding) to the support tape in the conventional manner and it is also possible to apply them directly to the articles if desired in a similar manner.

I claim:

1. A fastener comprising:

a pair of interdigitable coupling elements, each of said coupling elements having a multiplicity of carrier members extending transverse to its axis and in mutually spaced relation therealong;

a respective coupling head on each of said carriers, said coupling heads defining interhead spaces for receiving the heads of the other coupling element between them; and a pair of connecting strands unitary with the coupling element extending along each of said coupling elements in transversely spaced parallel relation, said strands forming flexible ligatures interconnecting the successive carriers and forming abutments limiting lateral displacement of said coupling elements upon the interdigitation of the heads thereof, each of said carriers having its head disposed centrally thereof whereby the heads of each element form a respective row, said strands flanking said rows, each of said carriers being arcuate and being formed with a respective head at the center thereof, said head being mushroom-shaped, said strands being disposed at the ends of said carriers and having semicircular profiles, said carriers, said head and said strands being formed unitarily from a synthetic-resin material.

2. The fastener defined in claim 1 wherein each of said carriers is provided adjacent the respective head with further abutments limiting the relative transverse shifting of said elements.

3. The fastener defined in claim 1 wherein each of said elements is an extruded profile.

4. The fastener defined in claim 1 wherein each of said carriers is formed inwardly of said strands and flanking the respective heads with a pair of abutments limiting relative lateral displacement of said coupling heads upon the interdigitation thereof.

* * * * *